US008752955B2

(12) United States Patent
Kobayashi et al.

(10) Patent No.: US 8,752,955 B2
(45) Date of Patent: Jun. 17, 2014

(54) INKJET PRINTER

(71) Applicants: Shun Kobayashi, Kanagawa (JP); Kazunori Bannai, Kanagawa (JP); Yoshikuni Ishikawa, Tokyo (JP)

(72) Inventors: Shun Kobayashi, Kanagawa (JP); Kazunori Bannai, Kanagawa (JP); Yoshikuni Ishikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 13/656,907

(22) Filed: Oct. 22, 2012

(65) Prior Publication Data

US 2013/0113869 A1 May 9, 2013

(30) Foreign Application Priority Data

Nov. 4, 2011 (JP) ..... 2011-242719

(51) Int. Cl.
*B41J 2/01* (2006.01)
*B65H 29/30* (2006.01)

(52) U.S. Cl.
USPC ..... 347/104; 271/193

(58) Field of Classification Search
USPC ..... 347/16, 104; 271/193, 264, 275, 18.1; 399/312, 314
See application file for complete search history.

(56) References Cited

U.S. PATENT DOCUMENTS

| | | | | |
|---|---|---|---|---|
| 5,121,170 | A * | 6/1992 | Bannai et al. | 399/303 |
| 7,264,347 | B2 * | 9/2007 | Maki et al. | 347/104 |
| 7,334,858 | B2 * | 2/2008 | Kogure et al. | 347/16 |
| 7,591,458 | B2 * | 9/2009 | Maki | 271/18.1 |
| 2002/0126193 | A1 | 9/2002 | Maki et al. | |
| 2004/0263603 | A1 | 12/2004 | Maki et al. | |
| 2006/0279621 | A1 | 12/2006 | Morohoshi | |

FOREIGN PATENT DOCUMENTS

| | | |
|---|---|---|
| JP | 5-8392 | 1/1993 |
| JP | 2005-15227 | 1/2005 |
| JP | 2006-231867 | 9/2006 |
| JP | 2006-232464 | 9/2006 |

* cited by examiner

*Primary Examiner* — Anh T. N. Vo
(74) *Attorney, Agent, or Firm* — Cooper & Dunham LLP

(57) ABSTRACT

An inkjet printer includes a movable conveyance belt, a first charging device, and a second charging device. Upon the conveyance belt, a recording medium is placed and conveyed at a given conveyance speed in a longitudinal, conveyance direction of the belt. The first charging device is disposed in contact with the belt while supplied with a first alternating current voltage to create a first electrified portion in the conveyance belt where positive and negative electric charges are arranged alternately with each other in the conveyance direction for electrostatically attracting the recording medium to the belt. The second charging device is disposed adjacent the belt to contact the recording medium conveyed on the belt while supplied with a second alternating current voltage to create a second electrified portion in the recording medium for cancelling an electric field originating from the first electrified portion of the belt.

13 Claims, 8 Drawing Sheets

INKJET PRINTER

CROSS-REFERENCE TO RELATED APPLICATION

This patent application claims priority pursuant to 35 U.S.C. §119 to Japanese Patent Application No. 2011-242719, filed on Nov. 4, 2011, the entire disclosure of which is hereby incorporated by reference herein.

BACKGROUND OF THE INVENTION

1. Technical Field

The present invention relates to an inkjet printer, and more particularly, to an inkjet printer that employs a movable conveyance belt upon which a recording medium is placed and conveyed during printing.

2. Background Art

Movable conveyance belts are used to convey a recording medium such as a sheet of paper during printing. The conveyance belt is used in conjunction with a print head that has a plurality of nozzles defined in its bottom, nozzle face from which ink is expelled in tiny droplets onto the recording medium entering a print zone immediately below the print head. Some print heads have an elongated, stationary configuration extending in a direction perpendicular to that in which the belt conveys the recording medium.

Generally, in stationary-head inkjet printers, the print head is positioned extremely close to the conveyance belt with a uniform gap of several millimeters left between the nozzle face and the recording medium for accurate placement of ink droplets on the recording medium. Displacement and deformation of the recording medium conveyed on the conveyance belt can adversely affect imaging quality. For example, curling causes partial separation the recording medium off the belt surface, making it impossible for ink droplets to land on intended, correct positions on the recording medium.

To stabilize the recording medium in shape and position during conveyance, some inkjet printers are equipped with a charging device that imparts electrostatic charges to the conveyance belt to electrostatically attract the recording medium to the conveyance belt.

For example, an inkjet printer has been proposed that includes a belt charging device that electrifies the conveyance belt to create positive and negative charges alternating each other along the length of belt, as well as a sheet charging device that electrifies at least the leading edge of the recording sheet to a polarity opposite that of a particular portion of the charged belt at which the recording sheet is placed. According to this method, the combined use of the belt and sheet charging devices effectively stabilize the sheet conveyed on the belt, where deposition of opposite charges on the belt and the sheet prevents partial separation of the recording sheet off the belt surface.

One problem encountered when employing electrostatic attraction for stabilizing the recording medium is that charging the conveyance belt results in a strong electric field originating from the charged belt surface and extending over the recording medium placed thereon. If not corrected, presence of such an electric field around the print head would lead to various adverse effects on imaging quality. For example, an electrostatic force exerted toward the nozzle face deflects ink droplets ejected from the nozzles, resulting in misplaced ink dots on the recording medium. In addition, an increased potential at the recording medium causes a back flow of tiny fragments of ink toward the nozzle face, which eventually clogs the nozzles or causes variations in the direction in which ink droplets are directed.

To cope with the problem, another, more sophisticated method has been proposed that employs an electrode for injecting charge of a polarity opposite that of the charged conveyance belt to the recording medium being conveyed on the belt. The charge injection electrode is energized by a power supply controlled according to the surface potential of the recording medium, which can vary depending on environmental or operational conditions, such as a type or thickness of recording medium in use. According to this method, provision of the charge injection electrode reduces the surface potential of the recording medium and neutralizes the electric field created over the recording medium.

Although effective for its intended purpose, the method described above is not sufficient. Injecting opposite charge to the recording sheet to reduce the surface potential of the recording sheet works only to an extent that prevents fragmentary droplets of ink from contaminating the print head, but does not completely remove the electric field created around the print head, causing misplacement of ink dots on the recording sheet. Moreover, power supply control according to the surface potential of the recording medium requires installation of a surface potential sensor, which would complicate the structure and operation of the Inkjet printer.

SUMMARY OF THE INVENTION

Exemplary aspects of the present invention are put forward in view of the above-described circumstances, and provide a novel inkjet printer.

In one exemplary embodiment, the inkjet printer includes a movable conveyance belt, a first charging device, and a second charging device. Upon the conveyance belt, a recording medium is placed and conveyed at a given conveyance speed in a longitudinal, conveyance direction of the belt. The first charging device is disposed in contact with the belt while supplied with a first alternating current voltage to create a first electrified portion in the conveyance belt where positive and negative electric charges are arranged alternately with each other in the conveyance direction for electrostatically attracting the recording medium to the belt. The second charging device is disposed adjacent the belt to contact the recording medium conveyed on the belt while supplied with a second alternating current voltage to create a second electrified portion in the recording medium for cancelling an electric field originating from the first electrified portion of the belt. The first electrified portion has a unit length in the conveyance direction equal to or smaller than the conveyance speed divided by a frequency of the first alternating current voltage. The second electrified portion has a unit length in the conveyance direction greater than the conveyance speed divided by a frequency of the second alternating current voltage.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
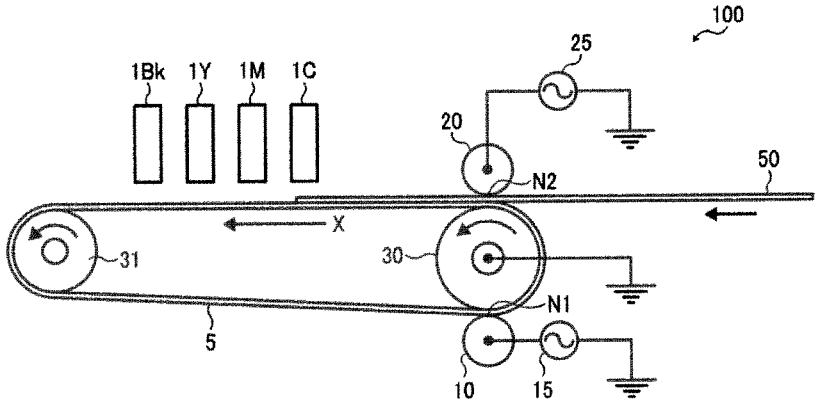
FIG. 1 is a schematic view of an inkjet printer incorporating first and second charging devices according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific clement includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 is a schematic view of an inkjet printer 100 according to one embodiment of this patent specification.

As shown in FIG. 1, the inkjet printer 100 includes an endless, movable conveyance belt 5 entrained around a pair of upstream and downstream, conveyance rollers 30 and 31 to rotate counterclockwise in the drawing to convey a recording medium 50, such as a sheet of paper, in a horizontal, conveyance direction X from right to left in the drawing. Also included are multiple print heads 1Bk, 1Y, 1M, and 1C (hereinafter, collectively referred to as "print heads 1") arranged in series along the conveyance belt 5 for ejecting ink of different primary colors, black, yellow, magenta, and cyan, as indicated by suffix letters Bk, Y, M, and C, respectively.

Specifically, in the present embodiment, each print head 1 comprises an elongated, stationary module extending in a direction perpendicular to the conveyance direction X in which the belt 5 conveys the recording sheet 50, having one or more linear arrays of nozzles defined in its bottom, nozzle face from which ink is expelled in tiny droplets onto the recording medium 50 entering a print zone immediately below the print head 1.

The number and combination of primary ink colors are not limited to that described herein, and the multiple print heads may be arranged in any suitable order depending on a specific application.

The conveyance belt 5 comprises a looped belt of multi-layered material, such as a bi-layer belt formed of an insulating layer and a conductive layer facing outside and inside, respectively, of the belt loop, or alternatively, a triple or more layered belt having one or more intermediate layers interposed between those facing layers.

The conveyance rollers 30 and 31 are rotatable cylindrical bodies of any suitable configuration, at least one of which is equipped with a rotary driver that imparts torque to the belt assembly. The upstream conveyance roller 30 may be electrically grounded. For facilitating ready separation of the recording sheet 50 from the conveyance belt 5, the downstream conveyance roller 31 may be configured to have a sufficiently small diameter, such that the sheet 50 separates off the belt surface due to a relatively large curvature of the roller 31.

During operation, the recording sheet 50 fed from an input sheet tray comes into contact with the conveyance belt 5 moving around the upstream conveyance roller 30. Upon placement on the conveyance belt 5, the incoming sheet 50 is conveyed toward the print zone where the sheet 50 faces the nozzle faces of the print heads 1 directed toward the conveyance belt 5.

As the recording sheet 50 reaches the print zone, each print head 1 actuates the inkjet nozzles to deposit ink droplets onto the incoming sheet 50 to create an image according to image data. The recording sheet 50 after passing through the print zone separates from the conveyance belt 5 around the downstream conveyance roller 31, followed by a suitable conveyance mechanism forwarding the resulting print to an output sheet tray disposed outside the apparatus body.

Generally, in stationary-head inkjet printers, the print head is positioned extremely close to the conveyance belt with a uniform gap of several millimeters left between the nozzle face and the recording medium for accurate placement of ink droplets on the recording medium. Displacement and deformation of the recording medium conveyed on the conveyance belt can adversely affect imaging quality. For example, curling causes partial separation the recording medium off the belt surface, making it impossible for ink droplets to land on intended, correct positions on the recording medium.

To stabilize the recording medium in shape and position during conveyance, some inkjet printers are equipped with a charging device that imparts electrostatic charges to the conveyance belt to electrostatically attract the recording medium to the conveyance belt.

With continued reference to FIG. 1, the inkjet printer 100 is shown further including a first charging device 10 disposed in contact with the conveyance belt 5 for electrifying the conveyance belt 5, and a second charging device 20 disposed adjacent the belt 5 to contact the recording sheet 50 for electrifying the recording sheet 50 conveyed on the belt 5.

Specifically, in the present embodiment, the first charging device 10 comprises a charging roller formed of a cylindrical core of metal covered with an outer elastic layer of conductive resin, such as sponged rubber. A high-voltage AC power source 15 is connected to the metal core of the roller 10, from which a high voltage of suitable AC waveform is supplied to the roller 10. The belt charging roller 10 is pressed against the conveyance roller 30 via the conveyance belt 5 to form a first charging nip N1 therebetween, and rotates as the belt 5 passes through the charging nip N1.

The second charging device 20 comprises a charging roller formed of a cylindrical core of metal covered with an outer elastic layer of conductive resin, such as sponged rubber. A high-voltage AC power source 25 is connected to the metal core of the roller 20, from which a high voltage of suitable AC waveform is supplied to the roller 20. The sheet charging roller 20 is pressed against the conveyance roller 30 via the conveyance belt 5 to form a second charging nip N2 therebetween, and rotates as the recording sheet 50 passes through the charging nip N2.

In the inkjet printer 100, the belt charging roller 10 serves to electrostatically charge the conveyance belt 5 to stabilize the recording sheet 50 in shape and position during conveyance on the conveyance belt 5.

During operation, as the conveyance belt 5 passes through the first charging nip N1, the belt charging roller 10, energized with the power supply voltage alternating between positive and negative potentials, creates an alternating pattern of positive and negative charges over the front, outer surface of the belt 5 in the conveyance direction X. Where the recording sheet 50, which is normally dielectric, contacts the conveyance belt 5, dielectric polarization takes place within the incoming sheet 50 where electric charges, opposite in polarity to those of the belt 5, are induced on the back surface of the sheet 50 adjoining the charged belt surface.

Figure 2:
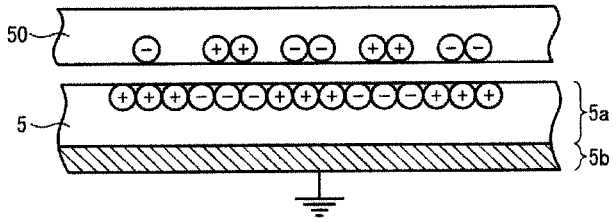
FIG. 2 is a schematic view of a conveyance belt included in the inkjet printer of FIG. 1.

With additional reference to FIG. 2, the conveyance belt 5 is shown having a bi-layered configuration consisting of an insulating layer 5*a* and a conductive layer 5*b*, defining front and back surfaces, respectively, with the recording sheet 50 placed on the front surface of the belt 5.

During dielectric polarization, the amount of electrical charges induced in the recording sheet 50 varies with time, as defined by the following equation:

$$q(t)=q_{\infty}(1-e^{-t/\tau}) \qquad \text{Equation 1}$$

where "q" represents the amount of electrical charges induced in the recording sheet 50, "t" represents a time elapsed since placement of the recording sheet 50 on the conveyance belt 5, and "τ" represents a relaxation time defined as a product of electrical resistance and capacitance of the recording sheet 50 placed on the conveyance belt 5.

Figure 3:
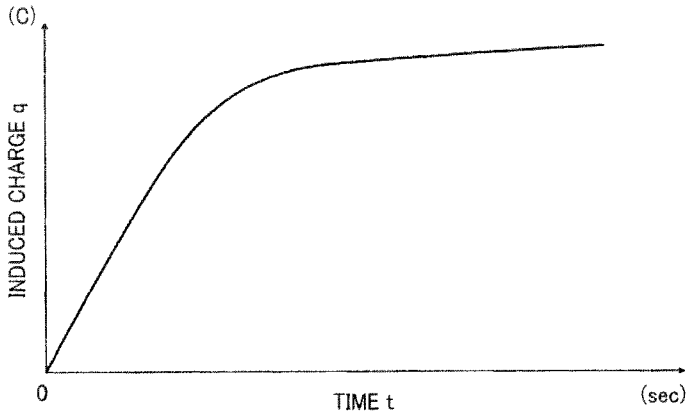
FIG. 3 is a graph showing an induced charge in a recording medium plotted against time elapsed since placement of the recording medium on the conveyance belt.

FIG. 3 is a graph showing the induced charge q, in Coulombs (C), in the recording sheet 50 plotted against time t, in seconds (sec), elapsed since placement of the recording sheet 50 on the conveyance belt 5, as derived from Equation 1.

As shown in FIG. 3, a substantial amount of induced charges rapidly builds up immediately after placement of the recording sheet 50 on the conveyance belt 5. Such reaction occurs within a short period of time after initiation of electrostatic induction, typically in the range of approximately 0.05 to several seconds, depending on the type of the recording medium and environmental conditions influencing the resistance of the recording medium.

As dielectric polarization progresses in the recording sheet 50, increasing electrostatic attraction between the opposite charges on the belt and sheet surface not only causes the sheet 50 to stay firmly in place on the belt surface, but also removes curls and wrinkles from the sheet 50, which then maintains a flat, smooth configuration upon entry into the print zone below the print heads 1.

One problem encountered when employing electrostatic attraction for stabilizing the recording medium is that charging the conveyance belt results in a strong electric field originating from the charged belt surface and extending over the recording medium placed thereon. If not corrected, presence of such an electric field around the print head would lead to various adverse effects on imaging quality. For example, an electrostatic force exerted toward the nozzle face deflects ink droplets ejected from the nozzles, resulting in misplaced ink dots on the recording medium. In addition, an increased potential at the recording medium causes a back flow of tiny fragments of ink toward the nozzle face, which eventually clogs the nozzles or causes variations in the direction in which ink droplets are directed.

Figure 4:
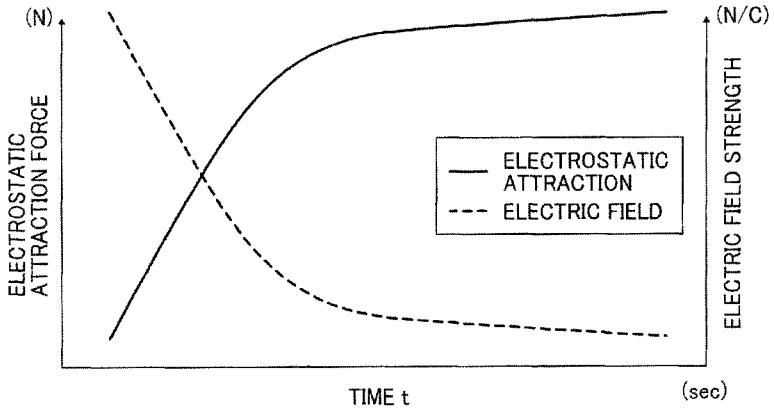
FIG. 4 is a graph showing an electrostatic attraction force between the recording medium and the conveyance belt (solid line) and a strength of electric field created over the recording medium (broken line), both plotted against time elapsed since placement of the recording medium on the conveyance belt.

FIG. 4 is a graph showing an electrostatic attraction force, in Newtons (N), between the recording medium and the conveyance belt (solid line) and a strength of electric field, in Newtons per Coulomb (N/C), created over the recording medium (broken line), both plotted against time, in seconds (sec), elapsed since placement of the recording medium on the conveyance belt.

As shown in FIG. 4, the electrostatic attraction between the recording medium and the conveyance belt increases with the duration of contact between the recording medium and the conveyance belt. Conversely, the electric field strength decreases with the duration of contact between the recording medium and the conveyance belt.

Thus, during a certain period since placement of the recording medium on the conveyance belt, the electrostatic attraction remains below a level required to retain the recording medium in proper shape and position on the conveyance belt, whereas the electric field strength remains excessively high to affect imaging performance of the print head. This is particularly true with a high-speed inkjet printer employing a stationary print head, where the conveyance belt moves at a relatively high conveyance speed, yielding a relatively short period of time during which the recording medium contacts the conveyance belt before entering the print zone.

To cope with the problem, the inkjet printer 100 according to this patent specification is provided with the first and second charging devices 10 and 20, the former electrifying the conveyance belt 10 to prevent displacement and deformation of the recording medium conveyed on the conveyance belt 10, and the latter electrifying the recording medium 50 conveyed on the belt 5 to prevent formation of an undesired, strong electric field originating from the charged belt surface and extending over the recording medium.

Specifically, in the inkjet printer 100, the first charging device 10 is disposed in contact with the conveyance belt 5 while supplied with a first alternating current voltage to create a first electrified portion Q1 in the conveyance belt 5 where positive and negative electric charges are arranged alternately with each other in the conveyance direction X for electrostatically attracting the recording medium to the belt. The second charging device 20 is disposed adjacent the conveyance belt 5 to contact the recording medium 50 conveyed on the belt 5 while supplied with a second alternating current voltage to create a second electrified portion Q2 in the recording medium 50 for cancelling an electric field originating from the first electrified portion Q1 of the belt 5.

The first electrified portion Q1 has a unit length Lq1 in the conveyance direction X equal to or smaller than the conveyance speed divided by a frequency of the first alternating current voltage, and the second electrified portion Q2 has a unit length Lq2 in the conveyance direction S greater than the conveyance speed divided by a frequency of the second alternating current voltage.

Figure 5:
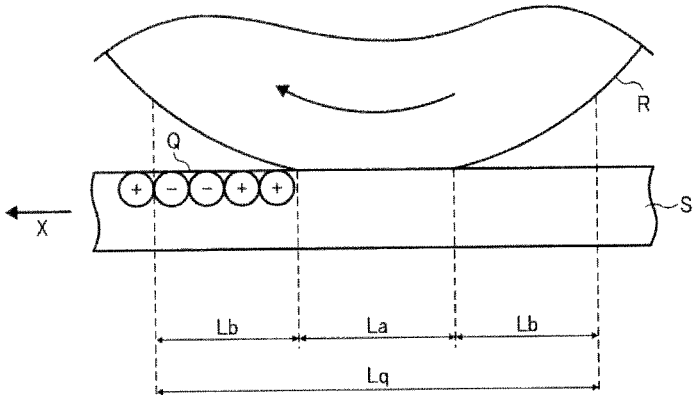
FIG. 5 is a schematic view of a charging roller pressed against a substrate.

With reference to FIG. 5, which is a schematic view of a charging roller R pressed against a substrate S, an electrified portion Q is shown having a given unit length Lq in the conveyance direction X in which the substrate S is conveyed.

As used herein, the term "electrified portion Q" refers to that portion of the substrate S (i.e., the conveyance belt 5 or the recording medium 50) which is electrified either by direct contact with the charging device R or by electrostatic corona discharge between the substrate S and the charging device R. Also, the term "unit length Lq" of the electrified portion Q refers to a length of an imaginary straight line extending in the conveyance direction X along which the substrate S is in contact with, or in close proximity with, the charging device R to be electrified upon energization of the charging device R.

Specifically, in the present embodiment, the electrified portion Q consists of a nip or contact portion where the charging roller R deforms into a flat configuration against the substrate S to establish direct contact between the adjoining surfaces of the charging device R and the substrate S, and a non-contact portion, contiguous to one end of the contact portion, where the charging device R and the substrate S are separate from each other with a small gap or spacing between the adjoining surfaces of the charging device R and the substrate S. The unit length of the electrified portion Q is defined by the following equation:

$$Lq=La+2Lb \qquad \text{Equation 2}$$

where "Lq" is the unit length of the electrified portion Q, "La" is the length of contact portion, and "Lb" is the length of non-contact portion contiguous to one side of the contact portion, all measured in the conveyance direction X.

With continued reference to FIG. 5, application of a high voltage to the charging roller R ionizes air within the gap between the substrate S and the charging roller R to create a flow of ions or electrons toward the substrate S.

According to Paschen's law, at 1 atmospheric pressure, electrostatic corona discharge occurs where a voltage of 310 V is applied between a pair of parallel plate electrodes placed apart from each other at a gap distance of approximately 8 μm therebetween. With the applied voltage being constant, an electrode of a highly curved configuration, such as a sharp pointed edge or ridged surface, causes local amplification of an electric field around the curved structure, which allows corona discharge to take place with a longer gap distance between the electrodes, than is the case with a planar plate electrode. For a particular type of electrode, increasing the voltage applied between the electrodes allows corona discharge to take place with a longer gap distance between the electrodes.

Thus, the unit length Lq of the electrified portion Q, which is the total length of the contact portion and the non-contact portions, changes depending on the configuration of the charging roller R and the voltage applied between the substrate S and the charging roller R.

For example, with an AC voltage of ±2 kV applied to the charging roller R being a 16-mm diameter cylinder, corona discharge occurs where a gap of approximately 30 μm or less exists between the substrate S and the charging roller R. In such cases, the length of contact portion La is approximately 1.5 mm and the length of non-contact portion Lb is approximately 0.7 mm, yielding an entire length Lq of the electrified portion Q of approximately 2.9 mm.

The inventors have recognized that the electrical potential to which the substrate S, be it the conveyance belt 5 or the recording medium 50, is charged with its associated charging device R depends on a charge cycle length relative to the unit length of the electrified portion Q created therein upon electrification of the charging device R.

As used herein, the term "charge cycle length" of the substrate S (i.e., the conveyance belt 5 or the recording medium 50) refers to a length travelled by the substrate S during one cycle of the AC voltage applied to the charging device R, that is, a conveyance speed of the substrate S divided by the frequency of the AC voltage applied to the charging device R:

$$Lp=V/f \qquad \text{Equation 3}$$

where "Lp" represents the charge cycle length of the substrate S charged by its associated charging device R, "V" represents the conveyance speed at which the substrate S is conveyed through the charging nip, and "f" is the frequency of the AC voltage applied to the charging device R.

Figure 6:
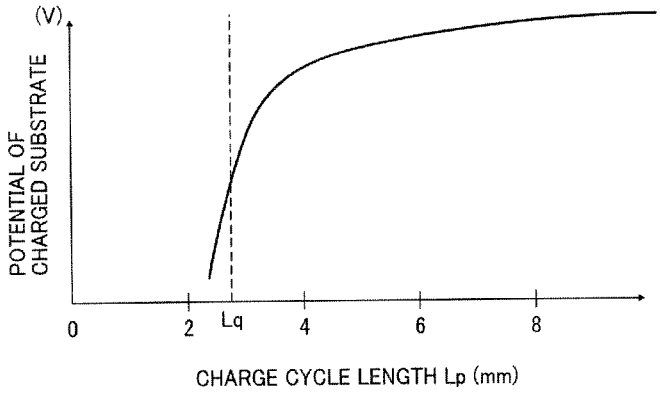
FIG. 6 is a graph showing an electrical potential to which the substrate is charged with the charging device, plotted against a charge cycle length travelled by the substrate during one cycle of an AC voltage applied to the charging device.

FIG. 6 is a graph showing the electrical potential, in voltages (V), to which the substrate S is charged with the charging device R, plotted against the charge cycle length Lp, in millimeters (mm), travelled by the substrate S during one cycle of an AC voltage applied to the charging device R.

As shown in FIG. 6, the potential of the charged substrate S significantly changes depending on whether the charge cycle length Lp exceeds or falls below a threshold length approximately equal to the unit length Lq of the electrified portion Q. That is, where the charging device R is energized by a pure AC power supply with no DC component superimposed thereon, the substrate S is charged to a higher potential with the charge cycle length Lp exceeding the unit length Lq of the electrified portion Q, and is discharged or otherwise charged only slightly with the charge cycle length Lp falling below the unit length Lq of the electrified portion Q.

Figure 7:
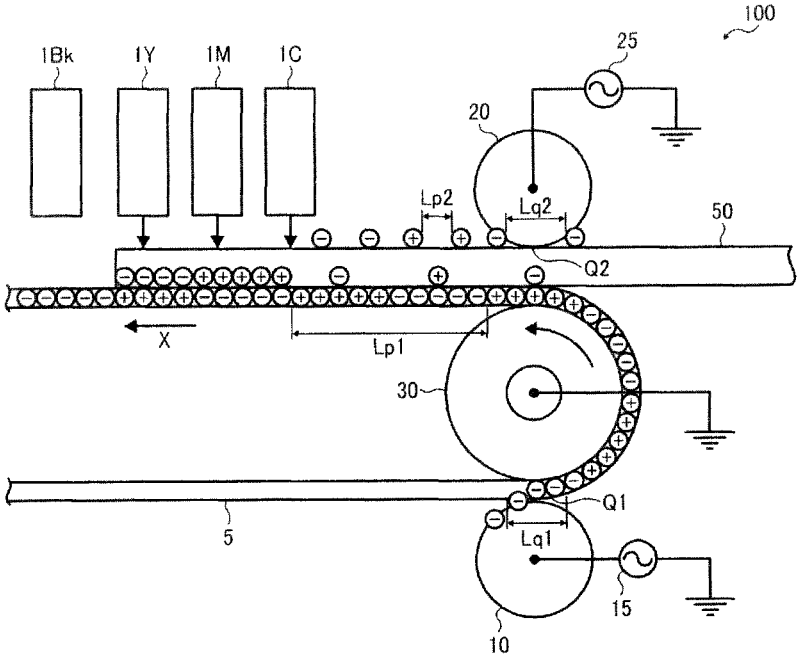
FIG. 7 is another schematic view of the inkjet printer of FIG. 1.

FIG. 7 is another schematic view of the inkjet printer 100 of FIG. 1, shown with electrified portions Q1 and Q2 created in the conveyance belt 5 and the recording sheet 50, respectively.

As shown in FIG. 7, the first electrified portion Q1, created in the conveyance belt 5 by the first charging roller 10, has a unit length Lq1 in the conveyance direction X equal to or smaller than a charge cycle length Lp1 travelled by the conveyance belt 5 during one cycle of the first AC voltage applied to the belt charging roller 10, that is, the conveyance speed divided by a frequency of the first alternating current voltage supplied to the first charging device 10, as follows:

$$Lq1 \leq Lp1 \qquad \text{Equation 4}$$

With the unit length Lq1 of the first electrified portion Q1 equal to or smaller than the charge cycle length Lp1 of the conveyance belt 5, the belt charging roller 10 creates a stable, clear alternate pattern of positive and negative charges recurring at the regular interval Lp1 along the conveyance belt 5 downstream from the first charging nip N1, which enables secure electrostatic attraction between the conveyance belt 5 and the recording sheet 50 during conveyance.

The second electrified portion Q2, created in the recording sheet 50 by the second charging roller 20, has a unit length Lq2 in the conveyance direction X greater than a charge cycle length Lp2 travelled by the recording sheet 50 during one cycle of the second AC voltage applied to the sheet charging roller 20, that is, the conveyance speed divided by a frequency of the second alternating current voltage supplied to the second charging device 20, as follows:

$$Lq2 > Lp2 \qquad \text{Equation 5}$$

With the unit length Lq2 of the second electrified portion Q2 greater than the charge cycle length Lp2 of the recording medium 50, the second charging device 20 imparts only a limited amount of electric charges, opposite in polarity to those of the charged belt 5, to the recording sheet 50 to counteract the alternate electrical charges on the surface of the belt 5 such that no electrical field is created adjacent to the nozzle faces of the print heads 1 as the recording sheet 50 reaches the print zone. Even in the presence of counteracting charges, the electric charges on the belt surface do not disappear due to the presence of the recording sheet 50 on the belt 5.

Further, the frequency of the first alternating current voltage is smaller than the frequency of the second alternating current voltage. That is, with the conveyance speed of the conveyance belt 5 being equal to that of the recording sheet 50, the charge cycle length Lp1 of the conveyance belt 5 is greater than the charge cycle length Lp2 of the recording sheet 50:

$$Lp1>Lp2 \qquad \text{Equation 6}$$

Figure 8:
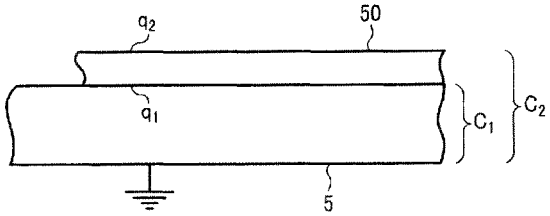
FIG. 8 is a schematic view of the conveyance belt and the recording medium in the inkjet printer of FIG. 1.

With additional reference to FIG. 8, the conveyance belt 5 and the recording sheet 50 are shown with a charge density $q_1$ of the belt 5, an electrostatic capacitance $C_1$ of the belt 5, a surface charge density $q_2$ of the recording sheet 50, and an electrostatic capacitance $C_2$ across the belt 5 and the sheet 50 combined.

Given that the potential at the front surface of the belt 5 is represented by the charge density $q_1$ divided by the electrostatic capacitance $C_1$, and the potential at the front surface of the recording sheet 50 is represented by the surface charge density $q_2$ divided by the electrostatic capacitance $C_2$, an electric field over the front surface of the recording sheet 50 is cancelled where the following condition is satisfied:

$$q_1/C_1+q_2/C_2=0 \qquad \text{Equation 7}$$

In the present embodiment, the frequency of at least one of the first and second alternating current voltages applied to the first and second charging devices 10 and 20, respectively, is adjustable, so as to adjust the charge cycle lengths Lp1 and Lp2 relative to each other. The waveform of these alternate current voltages may be sinusoidal, rectangular, or any suitable waveform.

Also, in the present embodiment, an amplitude of the second alternating current voltage is equal to or greater than a discharge voltage required to induce corona discharge between the recording medium 50 and the second charging device 2 across the second charging nip N2, which effectively causes transfer of charges to the front surface of the recording sheet 50 to counteract the alternate electric charges on the surface of the belt 5.

Figure 9:
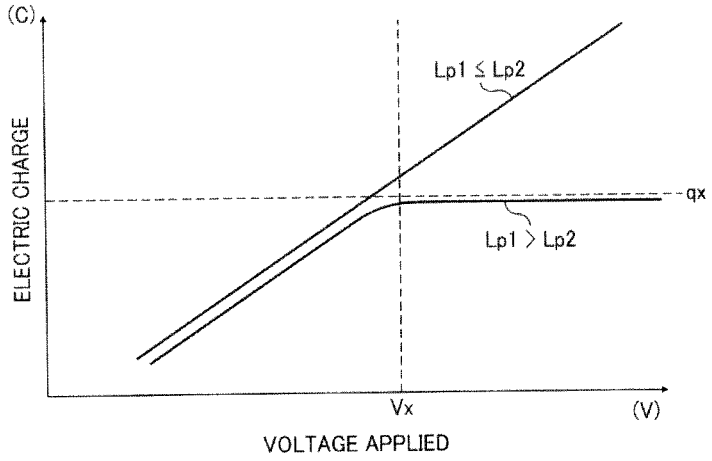
FIG. 9 is a graph showing a relation between a magnitude of electric charge imparted to the recording medium and a power supply voltage applied to the second charging device.

FIG. 9 is a graph showing a relation between the magnitude of electric charge imparted to the recording sheet 50 and the voltage applied to the second charging device 20, measured where the charge cycle length Lp1 of the conveyance belt 5 exceeds the charge cycle length Lp2 of the recording sheet 50 and where the charge cycle length Lp1 of the conveyance belt 5 does not exceed the charge cycle length Lp2 of the recording sheet 50.

As shown in FIG. 9, in both cases, the electric charge on the recording sheet 50 increases as the applied voltage increases toward a discharge voltage Vx required to cause corona discharge between the recording sheet 50 and the charging roller 20 across the second charging nip N2.

Note that the electric charge significantly differs between the two cases where the applied voltage exceeds the discharge voltage Vx. That is, where Lp1>Lp2, the electric charge on the recording sheet 50 stabilizes at a constant level qx just enough to cancel an electric field originating from the conveyance belt 5 with the applied voltage above the discharge voltage Vx. By contrast, where Lp≤Lp2, the electric charge on the recording sheet 50 increases constantly with the applied voltage above the discharge voltage Vx.

Thus, setting the charge cycle length Lp1 of the conveyance belt 5 greater than the charge cycle length Lp2 of the. recording sheet 50 causes the electric charge on the recording sheet 50 to stabilize at the constant level for effectively cancelling an electric field originating from the conveyance belt 5 as long as the voltage applied to the second charging device 20 is equal to or greater than the discharge voltage Vx.

For comparison purposes, and for facilitating an understanding of efficacy of the inkjet printer 100 according to this patent specification, consider cases where some or all of conditions as dictated by the Equations 4 through 6 are violated.

For example, where Lq1>Lp1, Lq2≤Lp2, and Lp1<Lp2, the conveyance belt 5 would have its surface potential reduced to zero due to the charging roller 10 removing charge from the belt surface, whereas the recording sheet 50 would be charged with positive and negative electric charges alternating at an interval of Lp2 due to the charging roller 20 imparting charge to the sheet surface.

In such cases, the charge on the recording sheet 50 would cause electrostatic attraction between the sheet 50 and the belt 5, while inducing an undesired electric field over the front surface of the recording sheet 50 to affect proper ejection of ink droplets from the print head, resulting in misplaced ink dots on the recording medium, or contamination of the print head with tiny fragments of ink.

On the other hand, where Lq1≤Lp1, Lq2≤Lp2, and Lp1=Lp2, the conveyance belt 5 would be charged with positive and negative electric charges alternating at an interval of Lp1 due to the charging roller 10 imparting charge to the belt surface, whereas the recording sheet 50 would be charged with positive and negative electric charges alternating at an interval of Lp2 due to the charging roller 20 imparting charge to the sheet surface.

In such cases, establishing proper electrostatic attraction between the sheet 50 and the belt 5 would require maintaining opposite electric charges on the sheet surface and the belt surface, which may be accomplished, for example, by adjusting the AC voltage supplies to the two charging rollers 10 and 20 out of phase by 180 degrees from each other, or otherwise by positioning the two charging rollers 10 and 20 such that the rollers 10 and 20 contact the belt 5 and the sheet 50, respectively, 180 degrees out of phases from each other.

Moreover, cancellation of an undesired electric field over the front surface of the recording sheet 50 would require precise adjustment of the voltage applied to the charging roller 20 to an optimal, discharge voltage, such that die electric charge on the recording sheet 50 stabilizes at a constant level just enough to cancel an electric field originating from the charges on the conveyance belt 5. Such optimization would be difficult, however, where the charge imparted to the recording sheet 50 can change depending on variations in the thickness and resistance of the recording sheet in use, or other operational or environmental conditions under which charging is performed. For example, in a configuration in which the charging roller 20 is located downstream from where the recording sheet 50 comes into contact with the belt 5, variations in the magnitude of charge induced in the recording sheet 50 upon placement on the belt 5 due to variations in resistance of the recording sheet 50 make it difficult to optimize the voltage applied to the charging roller 20.

All these difficulties are overcome in the inkjet printer 100 according to this patent specification, in which the unit lengths Lq1 and Lq2 of the electrified portions Q1 and Q2 are properly sized relative to the charge cycle lengths Lp1 and Lp2 of the conveyance belt 5 and the recording medium 50, respectively, and in which the charge cycle lengths Lp1 and Lp2 are properly sized, for example, by adjusting the frequency of AC power supply applied to the charging devices 10 and 20, respectively.

Figure 10:
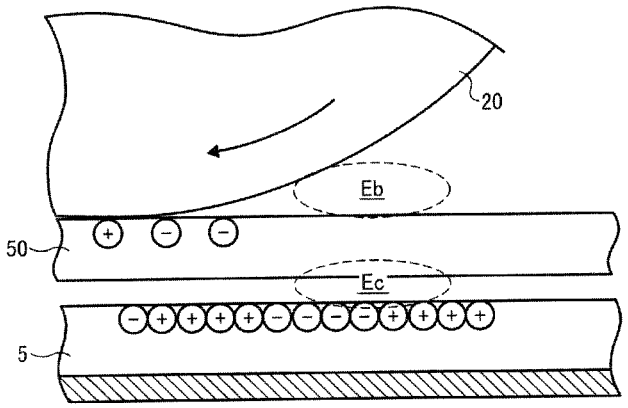
FIG. 10 is an enlarged schematic view of a charging nip defined between the conveyance belt and the second charging device.

FIG. 10 is an enlarged schematic view of the second charging nip N2 at which the belt charging roller 20 is pressed against the conveyance belt 5 via the recording sheet 50.

As shown in FIG. 10, around the charging nip N2, small gaps are created between the charging roller 20 and the recording sheet 50 and between the recording sheet 50 and the conveyance belt 5. Energizing the charging roller 20 creates local electric fields Eb and Ec, the former within the gap between the charging roller 20 and the recording sheet 50, and the latter within the gap between the recording sheet 50 and the conveyance belt 5. Corona discharge takes place in the stronger of these electric fields Eb and Ec but not within the sheet and the belt material, whose dielectric constants or permittivities are greater than that of air, and in which no electric field stronger than those in the air gaps can be created.

The strength of local electric field Eb is obtained by superposition of individual electric fields arising from different charge sources around the gap between the charging roller 20 and the recording sheet 5, as follows:

$$Eb=Eo+Es+Ek-Eu \qquad \text{Equation 8}$$

where "Eo" represents an electric field due to a voltage applied between the grounded, back surface of the belt 5 and the charging roller 20, "Es" represents an electric field due to the charged, front surface of the belt 5, "Ek" represents an electric field locally amplified around a highly curved structure, such as a sharp edge or ridged surface, of the charging roller 20, and "Eu" represents an electric field due to the induced charge on the back surface of the recording sheet 50 adjoining the charged belt surface.

The strength of local electric field Ec is obtained by superposition of individual electric fields arising from different charge sources around the gap between the recording sheet 50 and the conveyance belt 5, as follows:

$$Ec=Eo+Es+Eu \qquad \text{Equation 9}$$

where "Eo" represents an electric field due to a voltage applied between the grounded, back surface of the belt 5 and the charging roller 20, "Es" represents an electric field due to the charged, front surface of the belt 5, and "Eu" represents an electric field due to the induced charge on the back surface of the recording sheet 50 adjoining the charged belt surface.

Considering that the induced charge on the back surface of the recording sheet 50 is substantially equal to that on the front surface of the belt 5, and that the charged surfaces of the sheet 50 and the belt 5 are extremely close to each other, the electric field on the back surface of the recording sheet 50 eventually equals the electric field on the front surface of the belt 5 through electrostatic induction:

$$Eu(t)=Es(1-e^{-t/\tau}) \qquad \text{Equation 10}$$

where "Eu" represents an electric field due to the induced charge on the back surface of the recording sheet 50 adjoining the charged belt surface, "t" represents a time elapsed since placement of the recording sheet 50 on the conveyance belt 5, "τ" represents a relaxation time defined as a product of resistance and capacitance of the recording sheet 50 placed on the belt 5.

Introducing the time-dependent equation for the electric field on the back surface of the recording sheet 50 into Equations 8 and 9 yields:

$$Eb=Eo+Ek+Es*e^{-t/\tau} \qquad \text{Equation 8.1}$$

$$Ec=Eo+Es\,(2-e^{-t/\tau}) \qquad \text{Equation 9.1}$$

Thus, as the induced charge accumulates in the recording sheet 50, the electric field Eb decreases with time whereas the electric field Ec increases with time. Since corona discharge between the recording sheet 50 and the belt 5 would remove the alternate charges from the front surface of the belt 5, it is required to induce corona discharge within the roller-to-sheet gap, but not within the sheet-to-belt gap, for electrostatically attracting the recording sheet 50 to the belt 5. To this end, the following inequality should be satisfied:

$$Eb>Ec \qquad \text{Equation 10}$$

Using Equations 8.1 and 9.1, Equation 10 can be rewritten as follows:

$$Ek>2Es(1-e^{-t/\tau}) \qquad \text{Equation 10.1}$$

The condition for inducing corona discharge within the roller-to-sheet gap, as defined by the Equation 10.1 above, may be satisfied, for example, by reducing the diameter of the charging roller or by covering the charging device with a sponged rubber or bristled surface, which provides a highly curved structure, such as a sharp edge or ridged surface, for locally amplifying an electric field around the charging device.

Consider a configuration in which the recording sheet 50 comes into contact with the belt 5 and the charging roller 20 simultaneously, which translates into an absence of induced charge on the back surface of the recording sheet 50 regardless of the resistance of the recording sheet 50 due to an extremely small period of time elapsed since placement of the recording sheet 50 on the conveyance belt 5.

In such cases, the condition for inducing corona discharge within the roller-to-sheet gap may be satisfied by designing the charging device with a highly curved structure, such as a sharp edge or ridged surface, for locally amplifying an electric field around the charging device.

Further, consider a configuration in which the recording sheet 50 comes into contact initially with the belt 5 and subsequently the charging roller 20.

In such cases, the condition for inducing corona discharge within the roller-to-sheet gap may be satisfied as long as the time elapsed since placement of the recording sheet 50 on the conveyance belt 5 is sufficiently small, so as to allow for proper electrostatic attraction between the recording sheet 50 and the belt 5 while enabling cancellation of the electric field due to the charge on the belt 5.

Where more time has elapsed since placement of the recording sheet 50 on the conveyance belt 5 to violate the condition for corona discharge within the roller-to-sheet gap, the AC voltage supply to the charging roller 20 is terminated to prevent corona discharge within the sheet-to-belt gap. Even with the charging roller 20 de-energized, the electric field due to the charge on the belt 5 may be cancelled as the amount of induced charge on the recording medium 50 increases with the elapsed time.

Although in several embodiments described above, the inkjet printer 100 is depicted as employing a pair of charging rollers for charging a conveyance belt and a recording medium, the first and second charging devices 10 and 20 may be configured otherwise than depicted herein. Some such embodiments are described below with reference to FIGS. 11 through 15.

Figure 11:
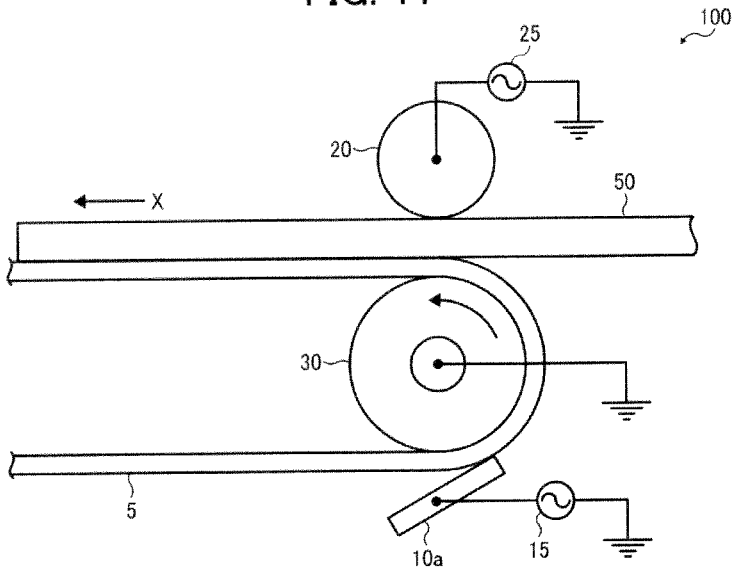
FIG. 11 is a partial schematic view of the inkjet printer, shown with the first charging device according to a further embodiment of this patent specification.

For example, as shown in FIG. 11, the first charging device 10 may be configured as a charging blade 10*a*, instead of a charging roller, held against the conveyance roller 30 via the conveyance belt 5. Such arrangement results in a shorter unit length Lq1 of the first electrified portion Q1 than that possible with a charging roller, which in turn allows for reducing the charge cycle length Lp1 travelled by the conveyance belt 5 during one cycle of the AC voltage applied to the charging device 10*a*.

Figure 12:
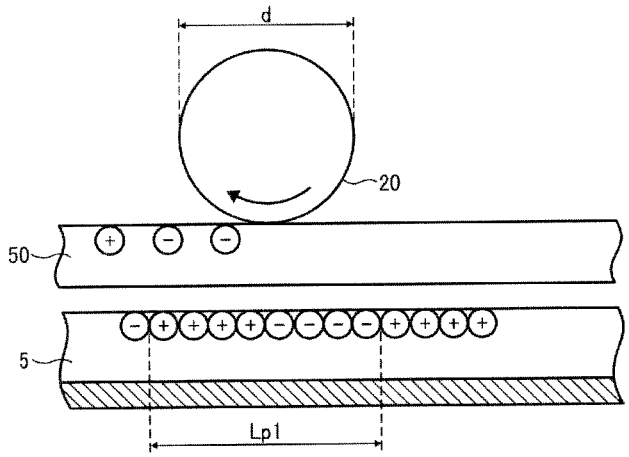
FIG. 12 is a schematic view of the second charging device included in the Inkjet printer according to a still further embodiment of this patent specification.
Figure 13:
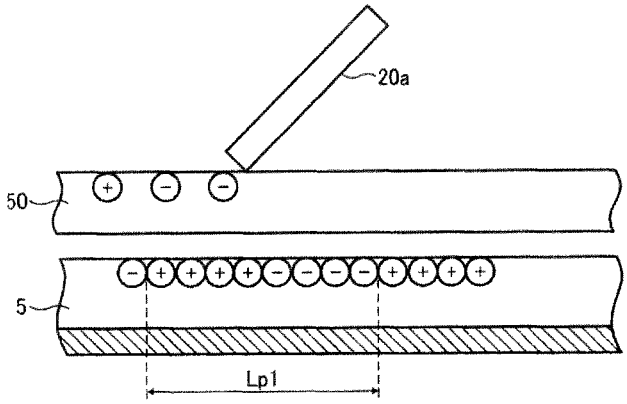
FIG. 13 is a schematic view of the second charging device included in the Inkjet printer according to a still further embodiment of this patent specification.
Figure 14:
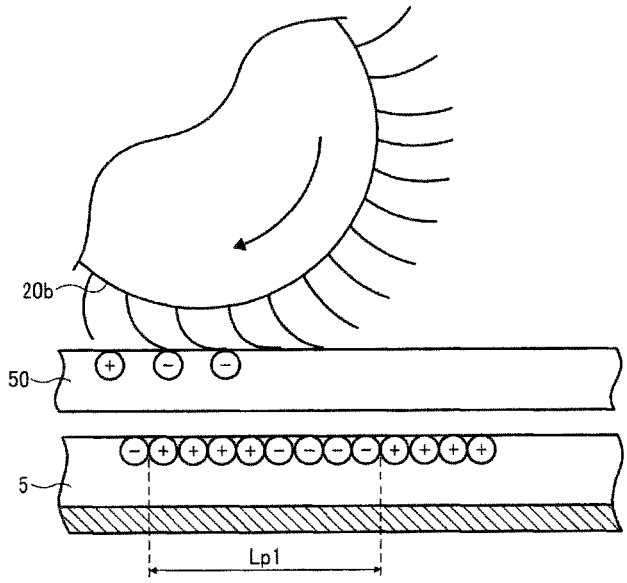
FIG. 14 is a schematic view of the second charging device included in the inkjet printer according to a still further embodiment of this patent specification.

Further, as shown in FIG. 12, the second charging device 20 may be configured as a small-diameter roller, the diameter d of which is equal to or smaller than the charge cycle length Lp1, that is, the conveyance speed divided by the frequency of the first alternating current voltage. Such arrangement facilitates corona discharge between the charging device 20 and the recording sheet 50, so as to reliably provide electrostatic attraction between the recording sheet 50 and the conveyance belt 5 without an undesired electric field over the recording sheet 50 even where the unit length of the electrified portion varies depending on environmental conditions, such as humidity and temperature.

Alternatively, instead of a smooth cylindrical roller, the second charging device 20 may be configured as a charging blade 20*a* (FIG. 13), or as a brush roller 20*b* (FIG. 14), or as an elongated sheet electrode extending in a direction perpendicular to the conveyance direction X and having a sharp edge to contact the recording medium 50. Such arrangement facilitates corona discharge between the charging device and the recording sheet 50, as is the case with the small-diameter roller. Compared to a smooth cylindrical roller, the charging device in the form of a blade or bristled surface more effectively facilitates corona discharge between the charging device 20 and the recording sheet 50 where the charge cycle length Lp1 of the conveyance belt 5 is extremely small. In particular, using the brush roller allows for uniform distribution of charge over the substrate.

Furthermore, where the conveyance belt 5 is configured as an endless belt looped for rotation around multiple conveyance rollers, the second charging device 20, in the form of a roller, blade, brush, or the like, is pressed against one of the conveyance rollers via the conveyance belt 5.

Figure 15:
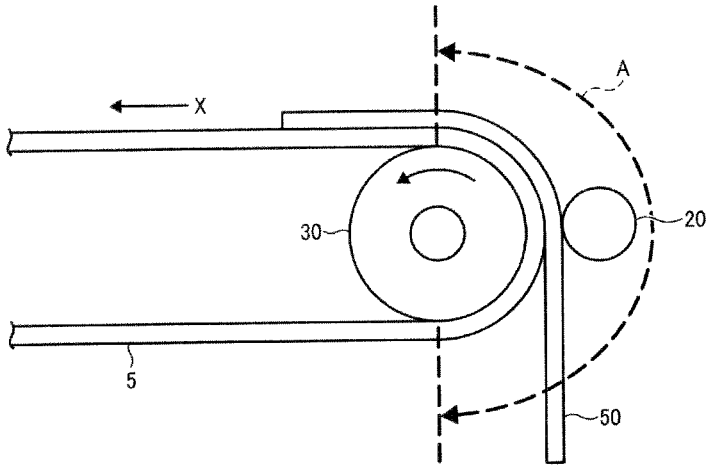
FIG. 15 is a partial schematic view of the inkjet printer, shown with the second charging device according to a still further embodiment of this patent specification.

Specifically, as shown in FIG. 15, the second charging device 20 is deployed along a particular portion of the conveyance belt 5 around the upstream conveyance roller 30, as indicated by an imaginary broken line A. Positioning the charging device 20 in such a specific position to press the recording sheet 50 against the conveyance roller 30 results in uniform, close contact between the sheet 50 and the belt 5, leading to more reliable protection against deformation and displacement of the sheet 50 during conveyance.

Hence, the inkjet printer 100 according to this patent specification can provide good imaging performance without defects on the print head for an extended period of time. Provision of the first charging device 10, which imparts electrostatic charges to the conveyance belt 5 to electrostatically attract the recording medium 50 to the conveyance belt 5, effectively prevents adverse effects on imaging quality, such as those caused by partial separation the recording medium off the belt surface, due to displacement and deformation of the recording medium conveyed on the conveyance belt. Further, provision of the second charging device 20, which imparts electrostatic charges, opposite in polarity to those of the conveyance belt 5, to the recording medium 50, effectively prevents formation of a strong electric field over the recording medium, which would otherwise affect proper ejection of ink droplets from the print head, resulting in misplaced ink dots on the recording medium, or contamination of the print head with tiny fragments of ink.

Numerous additional modifications and variations are possible in light of the above teachings. It is therefore to be understood that, within the scope of the appended claims, the disclosure of this patent specification may be practiced otherwise than as specifically described herein.

What is claimed is:

1. An inkjet printer, comprising:

a movable conveyance belt upon which a recording medium is placed and conveyed at a given conveyance speed in a longitudinal, conveyance direction of the belt;

a first charging device disposed in contact with the belt while supplied with a first alternating current voltage to create a first electrified portion in the conveyance belt where positive and negative electric charges are arranged alternately with each other in the conveyance direction for electrostatically attracting the recording medium to the belt; and a second charging device disposed adjacent the belt to contact the recording medium conveyed on the belt while supplied with a second alternating current voltage to create a second electrified portion in the recording medium for cancelling an electric field originating from the first electrified portion of the belt, the first electrified portion having a unit length in the conveyance direction equal to or smaller than the conveyance speed divided by a frequency of the first alternating current voltage, and the second electrified portion having a unit length in the conveyance direction greater than the conveyance speed divided by a frequency of the second alternating current voltage.

2. The inkjet printer according to claim 1, wherein the conveyance speed divided by the frequency of the first alternating current voltage is greater than the conveyance speed divided by the frequency of the second alternating current voltage.

3. The inkjet printer according to claim 1, wherein the frequency of the first alternating current voltage is smaller than the frequency of the second alternating current voltage.

4. The inkjet printer according to claim 1, wherein the frequency of at least one of the first and second alternating current voltages is adjustable.

5. The inkjet printer according to claim 1, wherein an amplitude of the second alternating current voltage is equal to or greater than that required to induce corona discharge between the recording medium and the second charging device.

6. The inkjet printer according to claim 1, wherein the first charging device includes s charging roller.

7. The inkjet printer according to claim 1, wherein the first charging device includes a charging blade.

8. The inkjet printer according to claim 1, wherein the second charging device includes a charging roller.

9. The inkjet printer according to claim 8, wherein a diameter of the charging roller is equal to or smaller than the conveyance speed divided by the frequency of the first alternating current voltage.

10. The inkjet printer according to claim 1, wherein the second charging device includes a charging blade.

11. The inkjet printer according to claim 1, wherein the second charging device includes a brush roller.

12. The inkjet printer according to claim 1, wherein the second charging device includes an elongated sheet electrode that extends in a direction perpendicular to the conveyance direction.

13. The inkjet printer according to claim 1, wherein the conveyance belt comprises an endless belt looped for rotation around multiple conveyance rollers, the second charging device being pressed against one of the conveyance rollers via the conveyance belt.

* * * * *